United States Patent [19]

Glaus et al.

[11] Patent Number: 5,054,614

[45] Date of Patent: Oct. 8, 1991

[54] TWISTABLE WIRE CLAMP FOR CONNECTING OR CLOSING OBJECTS

[75] Inventors: Heinrich Glaus, Niederwangen; Peter Lehmann, Kirchdorf; Hans Joehr, Kehrsatz; René Freiburghaus, Bern, all of Switzerland

[73] Assignee: Styner & Bienz AG, Niederwangen, Switzerland

[21] Appl. No.: 490,373

[22] Filed: Mar. 8, 1990

[30] Foreign Application Priority Data

Mar. 15, 1989 [EP] European Pat. Off. ..... 89810202.5

[51] Int. Cl.[5] ..... B65D 85/24

[52] U.S. Cl. ..... 206/343; 206/338; 24/67.9

[58] Field of Search ..... 206/338, 340, 343, 344; 24/67.9, 508, 502

[56] References Cited

U.S. PATENT DOCUMENTS

| | | | |
|---|---|---|---|
| 1,987,096 | 1/1935 | Chance | 206/338 |
| 2,111,404 | 3/1938 | Pankonin | 206/340 |
| 2,229,102 | 1/1941 | Leslie | 206/340 |
| 2,277,931 | 3/1942 | Moe | 206/340 |
| 2,390,219 | 12/1945 | La Place | 206/343 |
| 2,746,601 | 5/1956 | Rebichon | 206/340 |
| 3,078,533 | 2/1963 | Allen | 206/340 |
| 3,553,794 | 1/1971 | Kneidl et al. | 206/340 |
| 3,851,759 | 12/1974 | Young et al. | 206/338 |
| 4,334,613 | 6/1982 | Males et al. | 206/340 |
| 4,518,083 | 5/1985 | Mayer, Jr. | 206/340 |
| 4,798,231 | 1/1989 | Glaus et al. . | |

FOREIGN PATENT DOCUMENTS

| | | |
|---|---|---|
| 2458133 | 10/1976 | Fed. Rep. of Germany . |
| 714652 | 9/1931 | France . |

*Primary Examiner*—David T. Fidei

*Attorney, Agent, or Firm*—Marks Murase & White

[57] ABSTRACT

A twistable wire clamp for connecting objects has a V-shaped configuration, the lower portion of each of its two shanks forming an oblong loop having locking means consisting of the closed end of the narrower loop, on one hand, and of a locking member projecting towards the inside of the wider loop and extending in the same plane as the loop, on the other hand. On each side of the transitional portion between said two shanks, said clamp is provided with a respective shoulder. Said clamp is placed, by means of an apparatus, around the objects to be connected or the opening to be closed, after which said locking means are brought into engagement with one another by said apparatus, and said wire clamp is seized in the area of said transitional portion and twisted by a binding hook of the apparatus. Said loops are convex with respect to their plane, and said closed end portion has a thinning and is bent over towards said other loop. Such a wire clamp provides reliable operation of the apparatus when effecting connections.

4 Claims, 1 Drawing Sheet

TWISTABLE WIRE CLAMP FOR CONNECTING OR CLOSING OBJECTS

BACKGROUND OF THE INVENTION

The present invention relates to a twistable wire clamp for connecting or closing objects, said clamp having a V-shaped configuration, the lower portion of each of its two shanks forming an oblong loop having locking means consisting of the closed end of the narrower loop, on one hand, and of a locking member projecting towards the inside of the wider loop and extending in the same plane as the loop, on the other hand; said clamp being further provided with a respective shoulder on each side of the transitional portion between said two shanks; and which is adapted to be placed, by means of an apparatus, around the objects to be connected or the opening to be closed, after which said locking means are brought into engagement with one another by said apparatus and said wire clamp is seized and twisted by a binding hook of the apparatus. Such a wire clamp issues from WO-87-01753 of the same applicants, the present wire clamp being one of many embodiments disclosed in that application.

OBJECTS OF THE INVENTION

Such wire clamps are used in a method and in an apparatus for connecting at least two rods wherein said device places the wire clamps around the rods to be connected in such a manner that, as seen from the gripping member, the locking means of the wire clamps engage with one another behind said rods, and that the closed wire clamp is seized and twisted by the gripping member of said binding apparatus in front of said rods. It is important for such a method and apparatus that the wire clamps are seized one by one so as to perform their task without becoming wedged. Thorough tests have now shown that of the various wire clamps disclosed in that publication, the above-mentioned wire clamp is well suited for the considered method. In order to obtain practical operation and rational loading of the apparatus, a number of clamps are glued together, such an unit then being loaded into the apparatus.

Exhaustive tests have shown that is it desirable to improve said wire clamp in such a manner that its separation and particularly its safe locking as well as the undisturbed functioning of the apparatus may be guaranteed, and it is therefore the object of the present invention to provide such a wire clamp.

This object is attained by a wire clamp the loops of which are convex with respect to their plane and the closed end portion of which has an attenuation and is bent over towards the other loop.

BRIEF DESCRIPTION OF THE DRAWINGS

The invention is hereinafter explained in more detail with reference to a drawing of an embodiment.

DESCRIPTION OF THE PREFERRED EMBODIMENT

Figure 1:
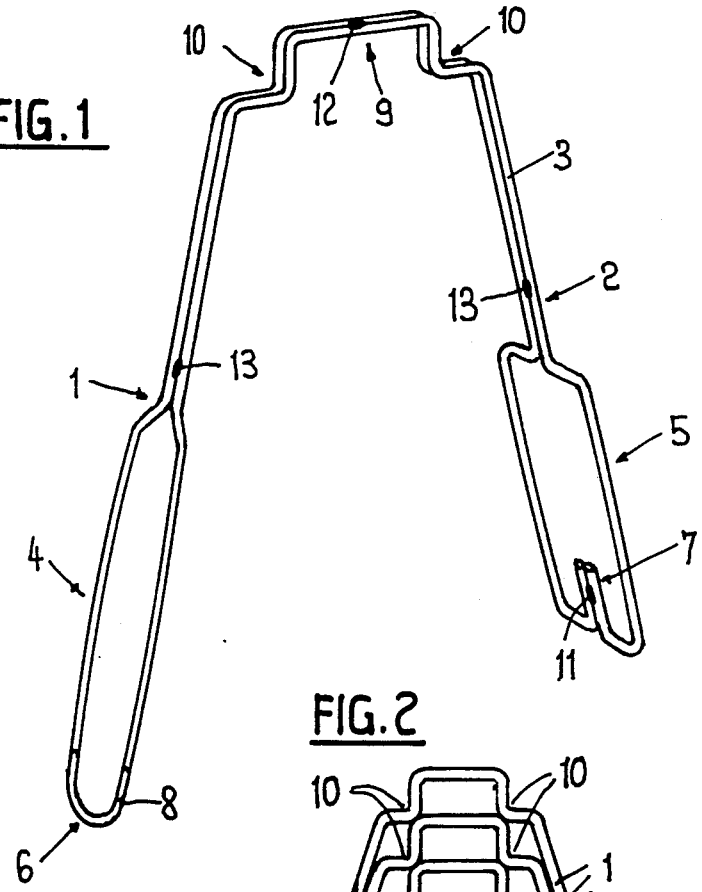
FIG. 1 shows the wire clamp of the invention in a perspective view.

The wire clamp according to FIG. 1 has a V-shaped configuration and comprises two shanks 1 and 2, the entire clamp consisting of a single wire 3. In their lower section, i.e., in the present example, starting from their center, the two shanks 1 and 2 form an oblong loop 4 respectively 5, the loop 4 that is provided with a closed end 6 being narrower than the other loop 5 and adapted to be inserted therein. A locking member 7 is disposed at the lower end of the wider loop 5, said locking member projecting towards the inside of the loop and extending in the same plane as the loop itself.

Figure 3:
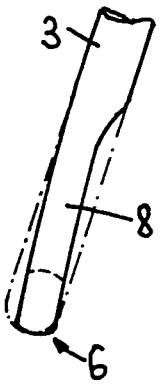
FIG. 3 shows another view of an enlarged detail of FIG. 2*a*.

FIG. 3 illustrates that the closed end 6 of the loop 4 is flattened, i.e. provided with a thinning 8 which is moreover bent over towards the other loop.

Figure 2:
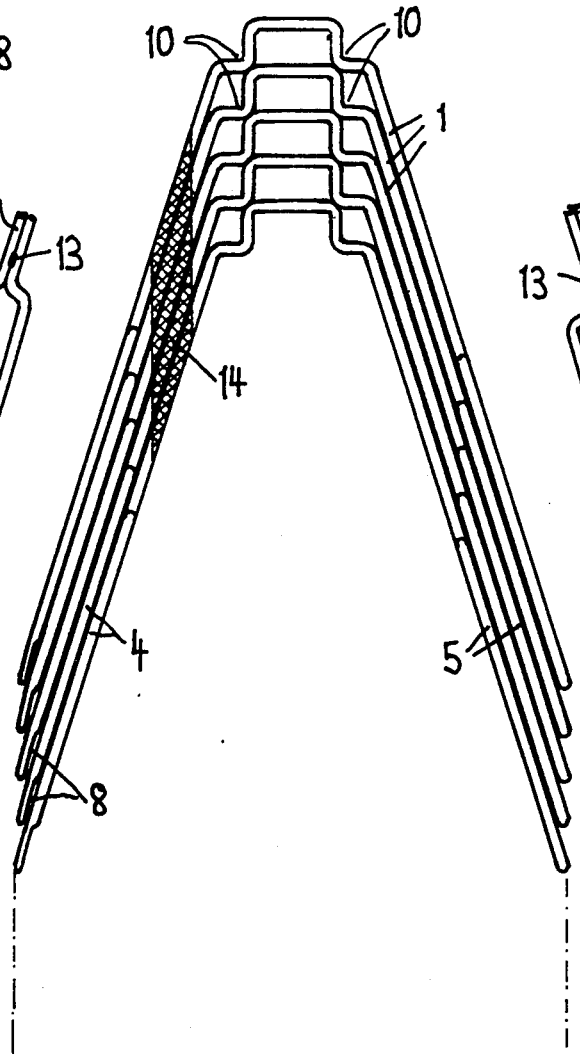
FIG. 2 shows several wire clamps according to FIG. 1 tacked together to form an unit.
Figure 2A:
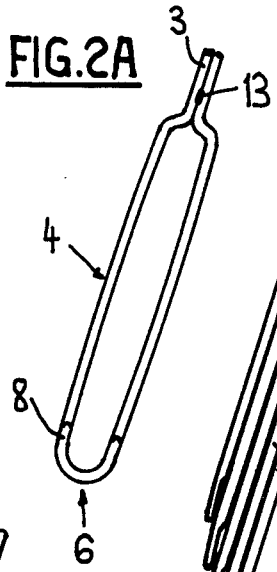
FIG. 2*a* shows a wire clamp of FIG. 2 from the left.
Figure 2B:
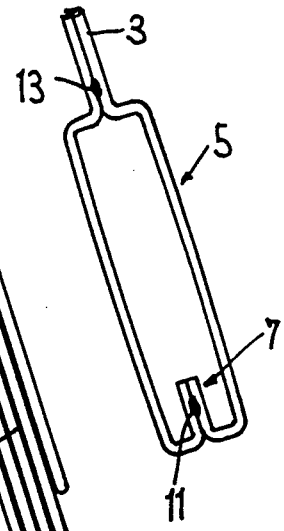
FIG. 2*b* shows a wire clamp of FIG. 2 from the right.

In addition, FIGS. 2*a* and 2*b* illustrate that the two loops 4 and 5 are slightly convex with respect to their planes.

On both sides of the transitional portion 9 between the two shanks, a shoulder 10 is formed which is engaged by a slide member of a binding and twisting apparatus. On principle, it would be sufficient to manufacture the wire clamp without joining the two wire sections together. For safety reasons, however, it is advantageous to connect the two wire sections by welding them together at certain points. In the present embodiment, the two wire sections are welded at four points, namely point 11 at the locking member 7, point 12 at the transitional portion 9, and points 13, where the two wire sections widen into the loops 4 and 5. The apparatus for which the wire clamps are intended seizes the wire clamp at its shoulders 10 and advances it through two jaws of the apparatus, said jaws placing the wire clamps around the objects to be connected or around the opening of an object to be closed, and the narrower loop 4 entering the wider loop 5 while the closed end 6 engages behind the locking member 7 of the other loop. During the following movements of the apparatus, a binding hook of the apparatus seizes the transitional portion 9 of the wire clamp and twists it.

As appears in FIG. 2, the clamps are tacked together by a suitable adhesive, to form an unit which may be inserted into the corresponding apparatus. A different adhesive may also be used. In the connecting or closing operation, first of all, the wire clamps have to be singled out. When closing the wire clamps, a certain force must be applied which should be imparted to the two shoulders 10 as evenly as possible. As a greater force has to be applied to the narrower loop because of the smaller curvature radius and dimensions, it has been obtained, by thinning and bending its end, that the forces acting onto the two loops are about equal.

Moreover, the wire clamps, i.e. their loops 4 and 5 must be guided in a passage of the apparatus, but preferably, these loops, i.e. the entire wire clamp, should not slide in the passages of the apparatus completely freely. The slightly convex configuration of the loops results in a slight spring action of the wire loops, so that after their individualization, they are held in the apparatus, and in an additional compensation of manufacture-dependent dimension differences.

Since the wire clamps are not symmetrically formed, and since they may therefore only be inserted into the apparatus in a certain position, units are provided with a marking 14 on one side.

In spite of the fact that the twistable wire clamp of the invention has been described with reference to a particular apparatus for connecting two objects, the wire clamp may also be used in devices working according to the same principle but of different design, particularly in devices for closing sacks or the like, instead of connecting two reinforcing rods, as disclosed in the above-mentioned application.

We claim:

1. A wire clamp comprising:

a first shank having a first end and a second end, said first end having a shoulder, said second end being oblong in shape and having a lower portion which is inwardly directed and thinner than said first end;

a second shank having a first end and a second end, said first end of said second shank having a shoulder, said second end of said second shank being oblong in shape and wider than said second end of said first shank, and having a lower portion with a locking means for locking said second end of said first shank with said second end of said second shank; and a transitional portion extending between said first end of said first shank and said first end of said second shank.

2. A wire clamp as in claim 1, wherein said wire clamp is formed from a single wire.

3. A wire clamp as in claim 2, wherein said wire is doubled over on itself and adjacent portions of said wire are welded at said transitional portion, said locking means, between said shoulder and said second end on said first shank, and between said shoulder and said second end on said second shank.

4. A wire clamp as in claim 1, wherein said wire clamp is adhesively combined with a plurality of wire clamps to form a unit.

* * * * *